US007204361B2

(12) United States Patent
Illedits

(10) Patent No.: US 7,204,361 B2
(45) Date of Patent: Apr. 17, 2007

(54) ESCALATOR WITH RISER BRUSHES, STEP OF SUCH AN ESCALATOR AND METHOD OF MODERNIZING AN ESCALATOR

(75) Inventor: Thomas Illedits, Neufeld (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/274,866

(22) Filed: Nov. 15, 2005

(65) Prior Publication Data

US 2006/0102448 A1 May 18, 2006

(30) Foreign Application Priority Data

Nov. 18, 2004 (EP) ..... 04105896

(51) Int. Cl.
*B66B 21/00* (2006.01)

(52) U.S. Cl. ..... 198/326

(58) Field of Classification Search ..... 198/326, 198/327, 328, 329, 330, 331, 332, 333
See application file for complete search history.

(56) References Cited

U.S. PATENT DOCUMENTS 2,981,397 A * 4/1961 Hansen ..... 198/325
4,470,497 A * 9/1984 Kraft ..... 198/333
5,042,641 A * 8/1991 Soldat ..... 198/496
5,176,239 A * 1/1993 Findlay et al. ..... 198/321
5,337,879 A * 8/1994 Fischer ..... 198/333
5,785,167 A * 7/1998 Rugg ..... 198/333
6,131,719 A * 10/2000 Gore ..... 198/326
6,595,344 B1 * 7/2003 Davis et al. ..... 198/323

FOREIGN PATENT DOCUMENTS

JP 01285581 A 11/1989
JP 08225285 A 9/1996
JP 11171462 6/1999
JP 2003073065 A 3/2003

* cited by examiner

*Primary Examiner*—Joe Dillon, Jr.
(74) *Attorney, Agent, or Firm*—Schweitzer Cornman Gross & Bondell LLP

(57) ABSTRACT

An escalator with steps having a tread surface and riser surface has riser brushes arranged at the riser surface. The riser brushes provide a barrier for the gap which is normally present between the tread surface of a first step and the riser surface of an adjacent step. The riser brushes may be mounted to a brush strip which is guided along the riser as the steps transfer between vertical and horizontal travel.

6 Claims, 5 Drawing Sheets

ESCALATOR WITH RISER BRUSHES, STEP OF SUCH AN ESCALATOR AND METHOD OF MODERNIZING AN ESCALATOR

The present invention relates to an escalator with steps, to a step of such an escalator and to a method of modernizing an escalator.

BACKGROUND OF THE INVENTION

The steps of a conventional escalator are fastened to two transport chains and form together therewith an endless, circulating step belt which runs over a respective pair of transport chainwheels at each of the two ends of the escalator, wherein one transport chainwheel pair belongs to a drive station and drives and deflects the step belt, and the other chainwheel pair is part of a step belt deflecting station. The individual steps of the step belt are each equipped with two front and two rear guide rollers, through which the steps are guided in a position-dependent orientation by guidance and deflection curves primarily fastened to the support construction of the escalator.

The steps of the escalator run along a predetermined path laterally defined by a stationary base plate. A passenger located on the tread surface of a trailing step stands opposite the riser surface of a leading step. In the outlet region the trailing step slides along the riser surface of the leading step, so that the riser surfaces of the leading and trailing steps come onto the same plane. Ribs are between two steps in order to minimise the contact area between the steps and a standing object. However, notwithstanding all this there is a gap between the ribs of two adjacent steps.

In order to provide compensation for tolerances a gap must remain between a leading step and a trailing step, since two steps bearing against one another would produce substantial friction which would lead to unacceptable heating and increase drive power as well as wear. For this reason a space or air gap must be left between leading and trailing steps.

A space or a gap of that kind is a safety risk. Due to the play which is present, the gap width can widen so that engagement therein of a shoe edge, heel, skirt hem or hand, particularly with children, is possible. As a consequence thereof the risk of squashing and other injuries for the passenger is present.

The injury of persons in the riser region caused by the relative movement between the moving steps is a principal problem of conventional escalators. Beyond that, if an object located on a moving step comes into contact with the opposite riser surface, the object can be drawn into the gap by friction and the simultaneous relative movement of the leading and trailing steps, particularly in the case of upward escalator travel.

Patent JP 11171462 discloses brushes which are arranged on a trailing step in order to clean the riser surface of the leading step. The brushes are disposed at a certain spacing below the tread surface, so that objects can jam in the gap disposed thereabove. Moreover, the brushes are in contact with the riser, can damage the riser and cause noise. In addition, such a construction has proved disadvantageous that the brushes, due to the constant friction with the riser, have only a very short service life. The forces exerted by the steps damage the structure of the brushes, which then have insufficient shape stability.

It is accordingly an object of the present invention to provide an escalator which does not have the above-mentioned disadvantages and which substantially increases operational reliability in conjunction with ease of manufacture and significantly extends service life.

BRIEF DESCRIPTION OF THE INVENTION

According to the invention an escalator with steps having a tread surface and a riser surface includes brushes arranged at the riser surface.

The surface of the escalator step on which the passengers stand is termed the tread surface. The riser surface is the front, approximately vertical surface of the escalator step. It is often curved, rounded or convex. The riser surface of a leading step is disposed opposite the feet of the passengers standing on the following step during upward travel of the escalator.

Riser brushes positioned in accordance with the invention allow a necessary prevention of contact of objects with the riser. The riser brushes prevent contact of objects with the riser and at the same time prevent penetration of objects into the gap between the riser and the trailing step. In addition, through the use of the riser brushes two unintended friction partners are separated by brushing. Foreign bodies, such as, for example, shoes, umbrellas, bags, plastic bags or other objects, are brushed away from the riser by means of the riser brushes, wherein the riser brushes push or brush the objects out of the risk area and thus the step gap. Consequently, pinching or wedging of objects is avoided or greatly minimized. The use of the escalator is thereby substantially enhanced and safety significantly increased.

The brushes eliminate any frictional contact with the riser relative to the escalator user or foreign bodies before penetration into the gap between the moving steps can take place. Particularly in the case of the transition radii where relative movement between two adjacent steps takes place, namely when a horizontal tread approaches—in upward movement—the riser running in front of it, any frictional contact in this critical region between tread and riser is prevented by the brushes.

The device in Patent JP 11171462 does not achieve these effects, since the brushes are arranged at a spacing below the tread surface. Rubbing of an object with the riser and penetration into the gap between the trailing and leading steps is not prevented.

In a preferred embodiment of the invention the riser brushes are arranged along the entire width of the riser surface in an approximately parallel direction with respect to the riser surface. The brushes are so oriented, mounted or arranged that the brushes are approximately parallel to the riser surface and project, along the riser surface, above the tread surface of the trailing step and thereby do not contact the riser. Contact with the riser takes place only when an object comes into frictional contact with the riser. In this embodiment of the invention any frictional contact between two objects is also prevented before a penetration into the gap between the moving steps.

In a second preferred embodiment of the invention the riser brushes are mounted on a brush strip which is movable along guide slots or special devices of the riser surface. Thus, it is advantageous in that the position of the riser brushes relative to the riser surface can be varied depending on when the steps are disposed in a horizontal or a rising travel.

In a further preferred embodiment of the invention the brush strip is guidable by a brush return guide along guide slots or special devices of the riser surface back into such a position that the riser brushes during horizontal travel of the steps do not protrude beyond the riser surface. In this embodiment the brushes, directed away from the tread surface, do not contact the feet of passengers and are also invisible.

In yet a further preferred embodiment of the invention, the riser brushes may consist of synthetic material, brass, or galvanized steel bristles. Prevention of frictional contact is further increased by the use of these materials. These materials moreover have the advantage of separating two objects in frictional contact in an easy, convenient, problem-free and reliable manner.

The riser brushes may be of special colors, for example yellow or red, so that a better capability of recognition with regard to danger zones is given. The riser brushes may also be fastened to the brush strip by being sprayed on, glued on, screwed together therewith, glued in or snapped in. Economic and simple normal production methods for the brushes can thus be used.

An escalator step incorporating riser brushes of the invention can be produced in a simple and economical manner as a semi-finished product and then inserted into an escalator in a quick and simple manner.

An escalator with steps having a tread surface and a riser surface can also be modernized by mounting riser brushes of the present invention at the riser surface. Other, conventional travel devices can also profit from the above-described advantages in a simple and quick manner by such a modernization method.

BRIEF DESCRIPTION OF THE DRAWINGS

A fuller understanding of the present invention will be obtained upon consideration of the following detailed description of preferred, illustrative embodiments, as illustrated in the annexed FIGS. 1 to 6, wherein.

DETAILED DESCRIPTION OF THE INVENTION

Figure 1:
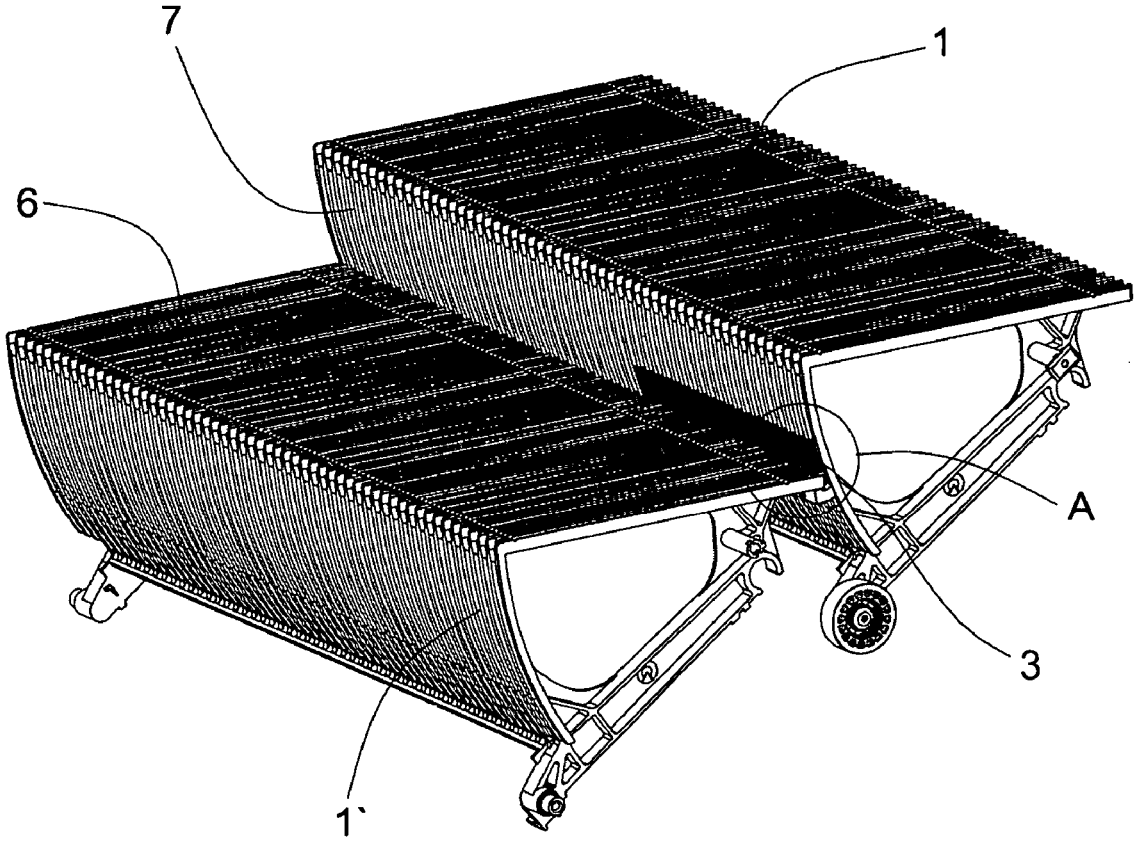
FIG. 1 is a diagrammatic representation of escalator steps with the step brushes according to the invention.
Figure 2:
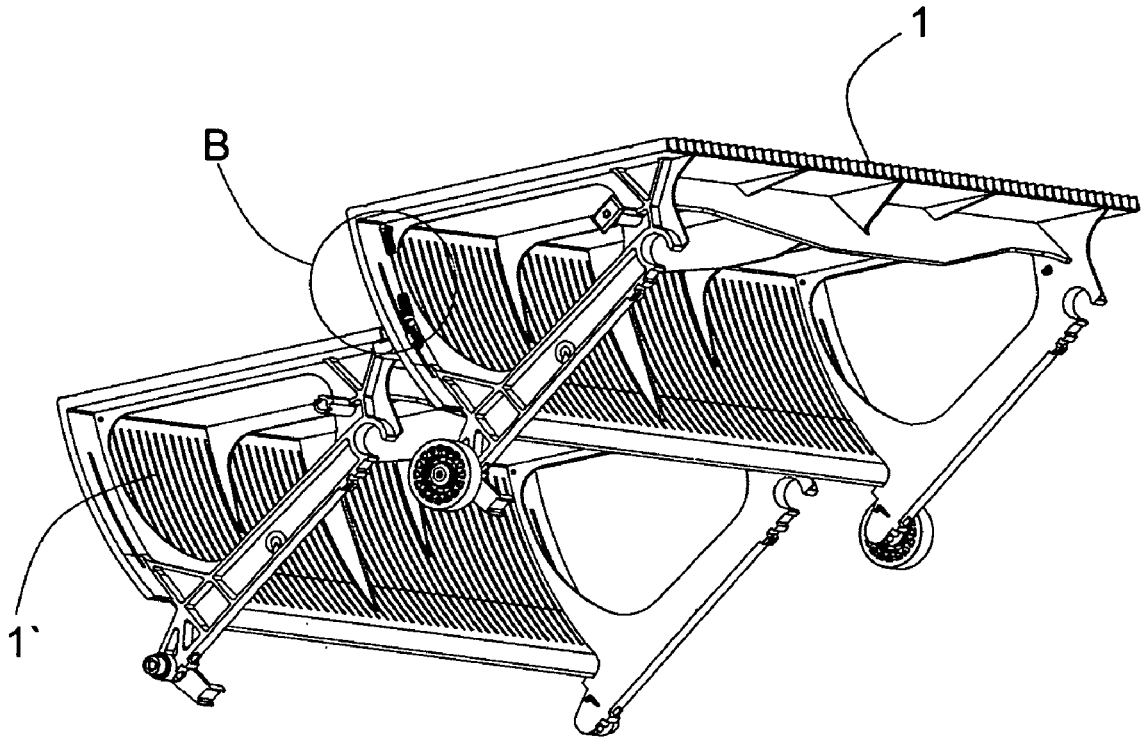
FIG. 2 is a depiction of the mechanical details of the schematic arrangement of FIG. 1, with step components displaced from their normal positions for clarity.

In FIG. 1 there can be seen in detail two steps 1' and 1 of an escalator, each of which has a tread surface 6 and a riser surface 7, wherein riser brushes 3 are arranged at the riser surface 7. The riser brushes 3 are preferably arranged along the entire width of the riser surface 7 in an approximately parallel direction with respect to the riser surface 7. The riser brushes can be inserted at the riser edges or over the entire area of the riser and along the entire riser region.

In the case of an escalator having a balustrade, the riser brushes 3 are mounted on all the escalator steps. The riser brushes 3 prevent, through minimization of contact, jamming or dragging along of shoes, umbrellas, bags, plastic bags or other objects. They prevent penetration of all foreign bodies: pieces of newspaper, plastic bags, pebbles, clothing fibres and coarser dirt as well as snow and ice into a step gap.

The brushes may be advantageously of a fanlike construction, widening towards the distal end, thus providing a fuller blocking disposition over the step gap. The step gap is barricaded and reaching of the escalator step edge is made impossible. A further advantage of the riser brushes 3 resides in the flexibility thereof relative to fixed edge elements or stationary plates. Thus, lateral contact by footwear is flexibly deflected and the space requirement, which may be needed, is freed.

The riser brushes 3 prevent, like a closed rampart of synthetic material bristles, penetration or reaching into the step gap. A sealed, hermetic, almost impermeable bristle boundary is disposed between the two escalator steps 1 and 1'. The spacing of the bristle ends from the riser can be controlled by the orientation and construction of the bristles.

Figure 3:
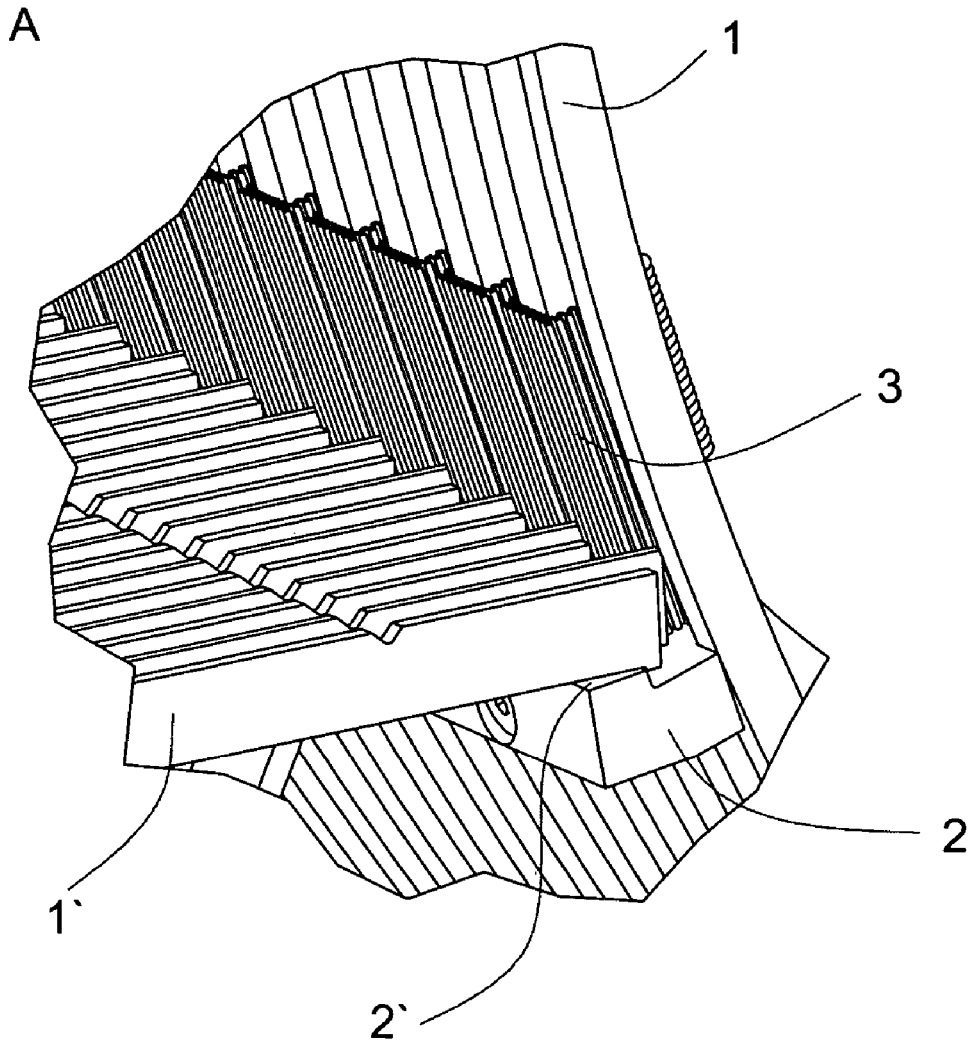
FIG. 3 is a detail view of portion A in FIG. 1.
Figure 4:
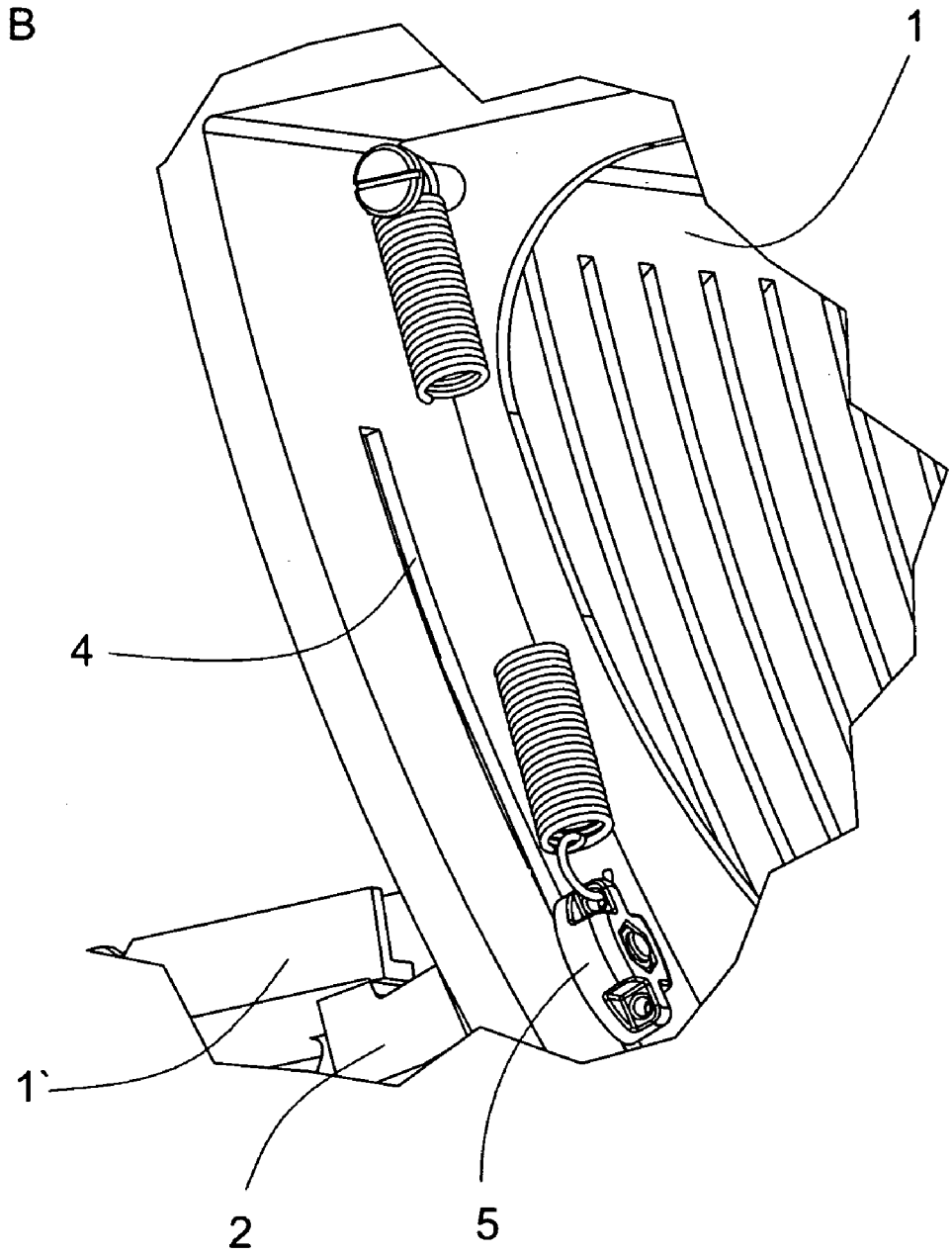
FIG. 4 is a detail view of portion B in FIG. 2.

As is illustrated in FIGS. 3 and 4, the riser brushes 3 may be mounted on a brush strip 2, which includes a brush strip support portion 2' that underlies the adjacent portion of the step tread surface of the following step. The brush strips 2 are moved and guided along guide slots 4 (see FIG. 4) on the riser of the escalator step 1. When two escalator steps 1 or 1' transition from a horizontal movement to an additional vertical movement, the two escalator steps 1 and 1' are displaced relative to one another along the riser region. In the case of this relative movement the trailing escalator step 1' entrains the brush strip 2 at the brush strip support 2' and moves the brush strip in the downward direction along guide slot 4. If the escalator steps 1 and 1' go from an additional vertical movement into a pure horizontal movement the brush strip 2 is guided back upwardly along the guide slot 4 by brush return guide 5 (see FIG. 4) on the rear side of the escalator step 1 by a tension or restoring spring until the support and guide abut the upper end of the guide slot 4. The abutment in the guide slot 4 is so positioned that the riser brushes 3 during horizontal travel of the escalator step 1 do not protrude above the steps 1 and 1' and the tread surfaces thereof. The brushes may be of a notched or toothed configuration, as seen in FIG. 3, or otherwise configured to conform to a grooved or otherwise contoured surface of the riser. The required brush configuration may be developed through incorporation of multiple bristles or an individual bristle element having the appropriate profile.

The riser brushes 3 can be mounted to the brush strip 2 by a spray process, by glue or adhesive, by screws or bolts, or by a snap fit. The riser brushes 3 can be, for example, yellow so as to give a clearly visible indication to the passengers that a gap is present. A clear notification of the risk or danger is thus given.

The riser brushes can also be used as tread limiters to replace synthetic material step edges. In this embodiment the riser brushes are inserted over the entire surface of the synthetic material edges and along the risers.

The riser brushes 3 form a barrier or block to the passengers and preclude or make difficult contact with the riser. No connection with the riser gap can be produced and pinching or wedging or squeezing is impossible. The riser brushes 3 thus decouple the moving escalator steps.

Sliding together is completely avoided by the riser brushes 3. Moreover, the riser brushes 3 are of such compact construction that they withstand loading by passenger traffic. Accordingly, a permanent, resistant, insensitive brush material, such as, for example, synthetic material, brass, or galvanised steel wire bristles, can be used. Sufficient dimensioning and design of the riser brushes 3 appropriate to number of passengers and the loadings consequent thereon, will be known to those skilled in the art.

According to a preferred embodiment of the invention the distal ends of the bristles of the riser brushes are rounded. This is advantageous, because the risk of injury of passengers on contact with the bristles is reduced.

Figure 5:
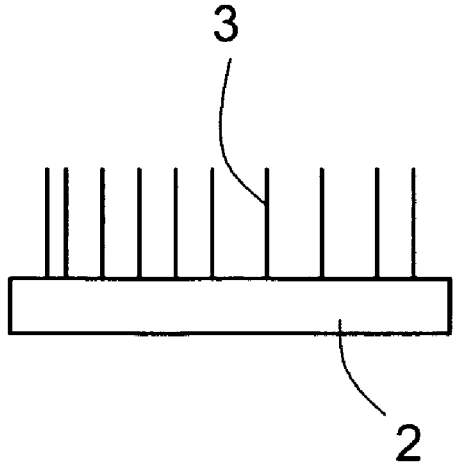
FIG. 5 is a schematicized view of a riser brush with straight bristles.
Figure 6:
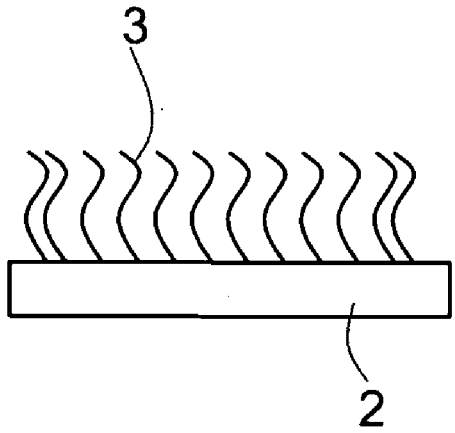
FIG. 6 is a schematicized view of a riser brush with wavy bristles.

According to a further embodiment of the invention the bristles of the brushes are wavy. This is advantageous, because such bristles have a higher degree of stability of shape and a longer service life. FIG. 5 shows riser brushes 3 with straight bristles, while FIG. 6 shows riser brushes 3 with wavy bristles.

The wave structure increases the mechanical strength of the bristles and enables better distribution of the forces exerted by objects or passengers. The wave structure stabilizes the bristles against bending obliquely to the longitudinal axis as compared to straight bristles. When straight bristles are pressed along the longitudinal axis, they bend and can no longer exert a counter-force. By contrast thereto, wavy bristles accept the force in the longitudinal axis as a spring stress, which is stored in the waves. The bristles retain their orientation and are not permanently bent.

The wave structure also reduces, by punctiform contact with the riser surface 7, friction with the riser. In addition, wavy bristles, by their density, substantially reduce the space or air gap between the running, driven escalator steps, wherein the risk of penetration of a foot of a passenger into the space or air gap is further reduced.

It is possible to arrange, at a step 1 for an escalator having a tread surface 6 and a riser surface 7, riser brushes 3 at the riser surface 7 in problem-free manner in a factory. This enables a rapid and simple mounting of the riser brushes 3 at the escalator and reduces production and assembly costs.

An escalator with steps 1 and 1', which have a tread surface 6 and a riser surface 7, can also be modernized through the subsequent mounting of riser brushes 3 at the riser surface 7. This modernization method enables, through mounting of the riser brushes 3, a quick and simple improvement to the escalator with respect to operational reliability and passenger safety, since the risk of jamming, pinching or wedging is substantially prevented.

I claim:

1. An escalator with steps that have a tread surface and a riser with a riser surface, characterized in that riser brushes are movably mounted to the riser of a step with an orientation approximately parallel to the riser surface to engage the riser surface of the step above a tread surface of a trailing step and that means are provided for guiding the brushes along the riser surface by the trailing step.

2. The escalator according to claim 1, characterized in that the riser brushes are arranged along an entire width of the riser surface in an approximately parallel direction with respect to the riser surface.

3. The escalator according to claim 1 or 2, characterized in that the riser brushes are mounted on a brush strip which is movably mounted in guide slots in the riser surface of the step.

4. The escalator according to claim 3, characterized in that the brush strip is guided along the guide slots of the riser surface by a device for brush return guidance such that the riser brushes do not project beyond the tread surface during horizontal travel of the steps.

5. The escalator according to claim 1 or 2, characterized in that the riser brushes are at least one of a) a synthetic, brass or galvanized steel bristle composition and b) yellow or red color.

6. A step for an escalator, the step having a riser surface and a tread surface, characterized in that at least one riser brush is mounted to the riser surface with an orientation approximately parallel to the riser surface to engage the riser surface of the step above a tread surface of a trailing step and that means are provided on the step for guiding the brushes along the riser surface by the trailing step.

* * * * *